US009580278B2

(12) United States Patent
Kalliomäki

(10) Patent No.: US 9,580,278 B2
(45) Date of Patent: Feb. 28, 2017

(54) ELEVATOR

(71) Applicant: KONE Corporation, Helsinki (FI)

(72) Inventor: Jaakko Kalliomäki, Vantaa (FI)

(73) Assignee: KONE CORPORATION, Helsinki (FI)

( * ) Notice: Subject to any disclaimer, the term of this patent is extended or adjusted under 35 U.S.C. 154(b) by 3 days.

(21) Appl. No.: 14/845,055

(22) Filed: Sep. 3, 2015

(65) Prior Publication Data

US 2016/0090272 A1 Mar. 31, 2016

(30) Foreign Application Priority Data

Sep. 25, 2014 (EP) ..... 14186333

(51) Int. Cl.

| | |
|---|---|
| ***B66B 7/06*** | (2006.01) |
| ***B66B 11/00*** | (2006.01) |
| ***B66B 7/10*** | (2006.01) |
| ***B66B 9/00*** | (2006.01) |

(52) U.S. Cl.

CPC ..... *B66B 7/06* (2013.01); *B66B 7/062* (2013.01); *B66B 7/068* (2013.01); *B66B 7/10* (2013.01); *B66B 9/00* (2013.01); *B66B 11/008* (2013.01)

(58) Field of Classification Search

CPC ..... B66B 7/06; B66B 7/068; B66B 11/008; B66B 11/08

See application file for complete search history.

(56) References Cited

U.S. PATENT DOCUMENTS 1,029,627 A * 6/1912 Pearson ..... B66B 11/0484 187/258
3,882,968 A * 5/1975 Suozzo ..... B66B 7/068 187/264
5,437,347 A * 8/1995 Biewald ..... B66B 7/10 187/264

(Continued)

FOREIGN PATENT DOCUMENTS

EP 1 918 238 A1 5/2008
WO WO 2009/080538 7/2009

*Primary Examiner* — Minh Truong

(74) *Attorney, Agent, or Firm* — Birch, Stewart, Kolasch & Birch, LLP

(57) ABSTRACT

An elevator, which includes a hoistway; and an elevator car vertically movable in the hoistway; and a counterweight vertically movable in the hoistway; and a number of upper rope wheels (in particular one or more) mounted higher than the car and counterweight, and a number of first ropes interconnecting the elevator car and counterweight, each of the more ropes passing around the one or more upper rope wheels; and a number of lower rope wheels mounted lower than the car and counterweight; and second ropes interconnecting the elevator car and counterweight, each passing around one or more of the lower rope wheels. The lower rope wheels include one or more first lower rope wheels; and one or more second lower rope wheels above the one or more first rope wheels. The second ropes include a first set of ropes forming a first U-shaped loop of ropes hanging from the car and counterweight and passing around the one or more first lower rope wheels; and a second set of ropes forming a second U-shaped loop of ropes hanging from the car and counterweight inside the first loop of ropes and passing around the one or more second lower rope wheels.

16 Claims, 2 Drawing Sheets

(56) References Cited

U.S. PATENT DOCUMENTS

| | | | | |
|---|---|---|---|---|
| 5,509,503 | A * | 4/1996 | Salmon | B66B 11/08 187/266 |
| 5,513,724 | A * | 5/1996 | De Jong | B66B 5/284 187/264 |
| 5,699,879 | A * | 12/1997 | Sakita | B66B 11/08 187/249 |
| 6,488,125 | B1 * | 12/2002 | Otsuka | B66B 7/068 187/254 |
| 7,717,237 | B2 * | 5/2010 | Zamorano Morfin | B66B 9/02 187/264 |
| 9,434,578 | B2 * | 9/2016 | Det | B66B 7/027 |
| 2006/0249337 | A1 * | 11/2006 | McNamara | B66B 7/10 187/412 |
| 2008/0121468 | A1 | 5/2008 | Fischer | |
| 2011/0005867 | A1 | 1/2011 | Kocher | |
| 2014/0182976 | A1 * | 7/2014 | Valjus | B66B 7/062 187/254 |
| 2015/0210509 | A1 * | 7/2015 | Talonen | B66B 7/06 187/258 |

* cited by examiner

ELEVATOR

FIELD OF THE INVENTION

The invention relates to an elevator for transporting passengers and/or goods. More specifically, the invention relates to passage and control of ropes hanging from the car of the elevator.

BACKGROUND OF THE INVENTION

An elevator typically comprises an elevator car and a counterweight, which are vertically movable in a hoistway. These elevator units are interconnected by first ropes (later referred to as suspension ropes or upper ropes) that suspend these elevator units on opposite sides of rope wheels mounted higher than the elevator units. For providing force for moving the suspension ropes, and thereby also for the elevator units, one of the wheels is typically a drive wheel engaging the suspension ropes, which drive wheel is rotated by a motor. Additionally, the elevator may need to be provided with second ropes between the elevator car and the counterweight, which second ropes hang from the elevator car and the counterweight. This type of arrangement is normally used to provide compensation for the weight of the hoisting ropes. Particularly, in this way the unbalance, which is caused by the suspension ropes in situations where the elevator car is run to its extreme position, can be eliminated. The second ropes can be guided to pass around a rope wheel mounted stationary in some suitable position lower than said elevator units. In the prior art, the rope ends have been fixed on the bottom structures of the car side by side in one long row, and the other end to the counterweight in a corresponding array.

A drawback of the solutions according to the prior art has been that when there's a need for numerous second ropes, the overall space consumption of the ropes causes layout problems. A wide row of ropes forms an obstacle that limits positioning of other components of the elevator. The width of the bottom beam of the car frame is often problematic, for instance. Generally, in elevators in relatively narrow space must be fitted several components, such as roller guides, safety gears, safety support, buffer plates and the hanger for the ropes. These several components typically need to be placed close to the vertical guide rail plane extending across the car projection. Also in the pit, the buffers and the rope wheels must be fitted in the same narrow space between the guides. The direct disadvantages of the know solutions come apparent in high rise—solutions where the number of ropes is typically the highest. In these solutions, the width of the hardware starts to significantly reduce freedom to use layouts that are preferred to optimize positioning of other components and thereby also the other functions of the elevator. With conventional ropes there is the possibility to use larger diameter ropes so as to reduce number of ropes, but these kiunds of ropes are problematic during installation and their diverting requires rope wheels with large diameter.

The above mentioned drawbacks have been noticed to be particularly problematic if the elevator is to be manufactured with belt-shaped ropes, because these kinds of ropes are particularly space consuming in the width direction. These issues regarding space consumption have been especially relevant in elevators where not only the rope structure as such but also the lateral guidance of the ropes requires lot of space.

BRIEF DESCRIPTION OF THE INVENTION

The object of the invention is, inter alia, to alleviate previously described drawbacks of known elevators and problems discussed later in the description of the invention. The object of the invention is particularly to introduce an elevator solution suitable for at least mid-rise use but more preferably even to high-rise use, wherein the layout of the elevator components is not strictly limited due to ropes, for example ropes passing via a rope tensioning system, such as one or more rope tensioning wheels. The object is further to provide an elevator solution wherein these drawbacks are alleviated and the rope diversion at the lower end of the hoistway can be arranged with relatively small diameter rope wheels. Advantageous embodiments are presented, inter alia, wherein a configuration is adaptable to fit in any elevator without differentiating wheel radius and/or bending radius of the ropes. Advantageous embodiments are presented, inter alia, wherein the ropes are in the form of belts.

It is brought forward a new elevator, which comprises a hoistway; an elevator car vertically movable in the hoistway; a counterweight vertically movable in the hoistway; a number of upper rope wheels, in particular one or more, which upper rope wheels are mounted higher than the car and the counterweight, particularly in proximity of the upper end of the hoistway; a number (in particular one or more) of first ropes (also referred to as the upper ropes) interconnecting the elevator car and counterweight, each of said one or more first ropes passing around said one or more upper rope wheels; a number of lower rope wheels mounted lower than the car and counterweight, particularly in proximity of the lower end of the hoistway, and a number of second ropes (also referred to as the lower ropes) interconnecting the elevator car and counterweight, each passing around one or more of the lower rope wheels. Said lower rope wheels comprise one or more first lower rope wheels and one or more second lower rope wheels above the one or more first lower rope wheels. Said second ropes comprise a first set of ropes forming a first U-shaped loop of ropes hanging from the car and counterweight and passing around said one or more first lower rope wheels; and further a second set of ropes forming a second U-shaped loop of ropes hanging from the car and counterweight, inside the first loop of ropes and passing around said one or more second lower rope wheels. In short, in the elevator said second set of ropes form a second loop of ropes inside the first loop of ropes. This is facilitated by the structure defined, said one or more second lower rope wheels being above the one or more first rope wheels and inside the first loop of ropes. With this kind of configuration one or more of the objects mentioned above are achieved. Particularly, space consumption of the lower ropes is thus reduced.

Preferably, the sections of the first set of ropes arriving vertically down from the car to said first lower rope wheels are at a first lateral rope-to-rope distance from the sections of the first set of ropes departing vertically upwards from said first lower rope wheels to the counterweight, and the sections of second set of ropes arriving vertically down from the car 1 to said lower second rope wheels are at a second lateral rope-to-rope distance from the sections of the second set of ropes departing vertically upwards from said second lower rope wheels to the counterweight, which second lateral rope-to-rope distance is smaller than said first lateral rope-to-rope distance. Thus, the second set of ropes fits inside the first loop of ropes, and the different sets of ropes are guided to pass relative to each other with a running clearance. Thus, the risks of contact, as well as risks of other disturbances between the ropes of the first set of ropes and the second set of ropes, can be reduced.

Preferably, said first and second lower rope wheels all have same diameter.

Preferably, said first lower rope wheels and second lower rope wheels are all mounted vertically movably. Thus, they can move downwards to tighten the second ropes. The wheels have then preferably a limited range of movement, preferably less than 2 meters, more preferably less than 1 meter, which range is adequate for tightening of ropes in most cases, yet not overly great to cause other problems regarding control of the wheel(s) as such and/or ropes during a possible jump-situation. Preferably, said first lower rope wheels and second lower rope wheels are all mounted on a common frame, which is vertically movable. Thus, rope tightening can be simply provided and controlled. In particular, the wheels are in this way connected to each other and movable vertically as one unit. The range of movement is preferably provided such that the frame is movable vertically a limited range of movement, preferably less than 2 meters, more preferably less than 1 meter. The elevator preferably further comprises a limiting mechanism for limiting the range of movement of the lower rope wheels, in particular to be less than said 2 meters, more preferably less than 1 meter. So as to ensure good control of movement, the frame is preferably movable in guides by a guiding mechanism. The guiding mechanism may comprise a guide rail mounted fixedly on a stationary structure and a counterpart therefor, mounted on the frame, preferably in the form of at least one slider or a roller element. The elevator preferably also comprises an urging device arranged to urge the lower rope wheels downwards so as to tighten the second ropes. Thus, a tightening function for tightening the second ropes is provided. Preferably, the elevator comprises one or more weights (W) arranged to urge (push or pull) the rope wheels downwards by force of gravity affecting on the weights. The overall weight of said tension weight(s) is preferably more than 100 kg. Preferably, the overall weight of said tension weight(s) is from 300 kg to 3000 kg, more preferably from 500 to 3000 kg, most preferably from 1000 kg to 2000 kg, and the lifting height of the elevator is 100 meters of higher. These specific ranges of tension weight are specifically suitable for elevators having lifting height of 100 meters or higher.

Preferably, said second ropes are belt-shaped. In particular, the width of the rope is larger than the thickness thereof in a transverse direction. The belt-shaped ropes turn around the lower rope wheels with their width directional face against the rim of the wheel in question. These kinds of ropes are particularly space consuming in the width direction and reducing space consumption of the lower ropes is critical. Saving space by dividing the lower ropes into two sets of ropes passing in the defined way reduces space consumption in the width direction of the rope bundle so that ropes can be suspended from the car and counterweight such that adequate room is left for other components and functions of the elevator even in cases where the rope number is great. Corresponding advantages can be obtained in the pit.

Preferably, said one or more first lower rope wheels includes two horizontally spaced apart first wheels having parallel axes of rotation. Thus, the ropes are diverted with a configuration that is adaptable to fit in any elevator without differentiating the wheel radius and/or bending radius of the ropes. The two first lower rope wheels are then spaced apart particularly in a radial direction and they have the same vertical plane of rotation whereby the ropes can pass between them with ease. It is preferable that the two first lower rope wheels are on the same vertical level radially adjacent each other. The ropes are preferably guided such that the first set of ropes arriving vertically down to the rim of one of said two first lower rope wheels, turns around it, departs the rim thereof horizontally, passes to the rim of the other one of said two first lower rope wheels, turns around it, and departs vertically upwards from the rim thereof. The horizontal distance between the two first lower rope wheels is preferably adjustable whereby the distance between them is quick to adjust during installation or readjustment of the elevator. For this purpose, the frame F preferably has several mounting positions (spaced in horizontal direction) for one or both of the first lower rope wheels.

Preferably, said one or more second lower rope wheels includes two horizontally spaced apart second wheels having parallel axes of rotation. Thus, the ropes are diverted with a configuration that is adaptable to fit in any elevator without differentiating the wheel radius and/or bending radius of the ropes. The two second lower rope wheels are then spaced apart particularly in a radial direction and they have the same vertical plane of rotation whereby the ropes can pass between them with ease. It is preferable that the two second lower rope wheels are on the same vertical level radially adjacent each other. The ropes are preferably guided such that the second set of ropes arriving vertically down to the rim of one of said two second lower rope wheels, turns around it, departs the rim thereof horizontally, passes to the rim of the other one of said two second lower rope wheels, turns around it, and departs vertically upwards from the rim thereof. The horizontal distance between the two second lower rope wheels is preferably adjustable whereby the distance between them is quick to adjust during installation or readjustment of the elevator. For this purpose, the frame preferably has several mounting positions (spaced in horizontal direction) for one or both of the first lower rope wheels.

Preferably, said two first lower rope wheels are radially adjacent each other at a first lateral distance and said two second lower rope wheels are radially adjacent each other at a second lateral distance, which is smaller than said first distance.

Preferably, said lower rope wheels are mounted inside the lower end of the hoistway.

Preferably, said upper rope wheels are mounted inside the upper end of the hoistway or inside a space beside or above the upper end of the hoistway.

Preferably, the vertical projections of the first lower rope wheels and the vertical projections of the second lower rope wheels substantially overlap. It is further preferable that the vertical projections of the first lower rope wheels and the vertical projections of the second lower rope wheels overlap only partially because thereby ropes of the first set and the second set can be effectively guided to pass relative to each other with adequate running clearance.

Preferably, the ropes of the first set of ropes and the ropes of the second set of ropes are interlaced as viewed in an axial direction of the rope wheels, i.e. ropes of the first set of ropes are positioned at the point of spaces between immediately adjacent ropes of the second set of ropes, and ropes of the second set of ropes are positioned at the point of spaces between immediately adjacent ropes of the first set of ropes, as viewed in the axial direction of the rope wheels. The ropes are then preferably centrally positioned at the point of said spaces.

Preferably, the first lower rope wheels and the second lower rope wheels are axially offset such that the ropes of the first set of ropes and the ropes of the second set of ropes are interlaced as viewed in axial direction of the rope wheels. This is preferably facilitated such that the circumferential rope contact areas of the first and second wheels are offset in axial direction of the wheels.

Preferably, each lower rope wheel comprises a plurality of circumferential rope contact areas distributed in axial direction thereof, one of said second ropes passing against each circumferential rope contact area. Preferably, each of said rope contact areas is cambered. In this way the axial position of each rope is controlled. When the axial position is controlled in this way, the space consumption is increased, whereby in this context the space savings obtained with the configuration according to the present invention is especially advantageous.

Preferably, all said first and second lower rope wheels have a parallel axis of rotation.

Preferably, the spaces between immediately adjacent ropes of the first set of ropes are greater than the width of an individual rope and the spaces between immediately adjacent ropes of second set of ropes are greater than the width of an individual rope. This is particularly preferable when the ropes of the first set of ropes and the ropes of the second set of ropes are interlaced, because thus the risks of contact, as well as risks of other disturbances between the ropes of the first set of ropes and the second set of ropes can be reduced. As a consequence, running clearances can be set small. Thanks to having a great space between immediately adjacent ropes, it is also possible to reduce likelihood of rope contact between immediately adjacent individual ropes or ropes resting against the wheel, which is especially important when the axial guidance of ropes is provided with a cambered shape of the wheel.

Preferably, ropes of said first and second set of lower ropes have all similar cross-sectional structure.

The elevator is preferably such that the car thereof is arranged to serve two or more landings. The elevator preferably controls movement of the car in response to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
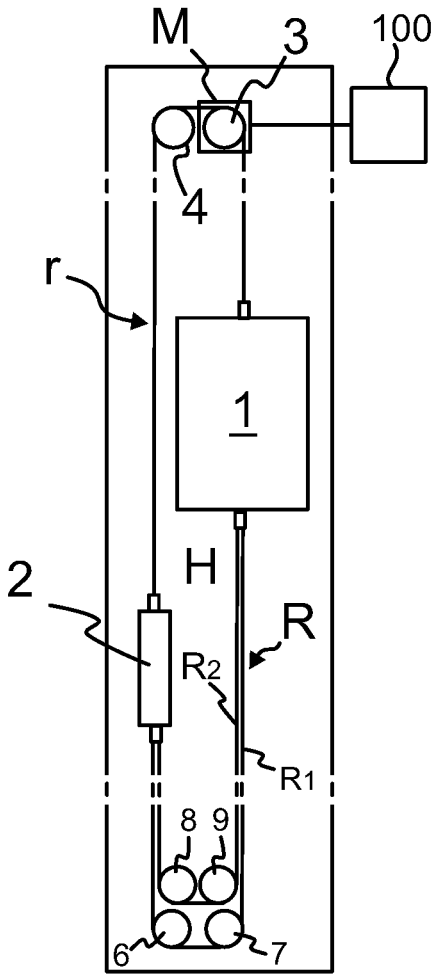
FIG. 1 illustrates schematically an elevator according to an embodiment of the invention as viewed from the side.

FIG. 1 illustrates an elevator, which comprises a hoistway H, an elevator car 1 vertically movable in the hoistway H, and a counterweight 2 vertically movable in the hoistway H.

The elevator comprises one or more upper rope wheels 3, 4 mounted higher than the car 1 and counterweight 2, in particular in proximity of the upper end of the hoistway H. In this case there are two of said rope wheels 3, 4. The elevator further comprises first ropes r interconnecting the elevator car 1 and counterweight 2, each of said one or more ropes r passing around said upper rope wheels 3, 4. The first ropes r suspend the car 1 and counterweight 1 on opposite sides of said upper rope wheels 3, 4. Preferably, said one or more upper rope wheels 3, 4 comprises a drive wheel 3 engaging said first ropes, and the elevator further comprises a motor M for rotating the drive wheel 3. Thus, the elevator car can be moved. The elevator further comprises an automatic elevator control 100 arranged to control the motor M, whereby rotation of the drive wheel 3 and thereby also the movement of the car 1 is automatically controllable.

The elevator further comprises a plurality of lower rope wheels 6, 7, 8, 9 mounted lower than (i.e. in a lower position than) the car 1 and the counterweight 2, in particular in proximity of the lower end of the hoistway H, and a plurality of second ropes R interconnecting the elevator car 1 and counterweight 2, each second rope R passing around one or more of the lower rope wheels 6, 7, 8, 9. Said lower rope wheels 6, 7, 8, 9 serve the purpose of diverting the second ropes R. Said lower rope wheels 6, 7, 8, 9 comprise one or more first rope wheels 6, 7 and one or more second rope wheels 8, 9, which are positioned above the one or more first rope wheels 6, 7. Said second ropes R have two sets of ropes R1 and R2, which pass otherwise a substantially similar route, but are diverted by different lower rope wheels. In particular, said second ropes R comprise a first set of ropes R1 passing around said one or more first lower rope wheels 6, 7 and forming a first loop of ropes. The first loop of ropes is substantially u-shaped and hangs between the car 1 and counterweight 2. Said second ropes R further comprise a second set of ropes R2 passing around said one or more second lower rope wheels 8, 9 forming a second loop of ropes. The second loop of ropes formed by the second set of ropes R2 is also substantially u-shaped and hangs between the car 1 and counterweight 2. As mentioned, said one or more second lower rope wheels 8, 9 are above the one or more first rope wheels 6, 7, whereby they are inside the first loop of ropes. Thus, it is provided that in the elevator said second ropes form a second loop of ropes inside the first loop of ropes. Thus, the overall space consumption of the rope bundle formed by all the lower ropes R can be reduced in the width direction of the rope bundle. In the preferred embodiment, one end of each rope R is fixed to the car 1 and the other end to the counterweight 2.

Said second ropes R are preferably belt-shaped, i.e. the width of each rope is larger than the thickness thereof in the transverse direction of the rope. In this case, they turn around the rope wheels 6, 7, 8, 9 their wide face (i.e. the width directional face) against the rim of the wheel in question.

It is preferable, as illustrated in Figures, that said first and second lower rope wheels all have same diameter. Thus, the ropes of said first and second set of the lower ropes R1, R2 can have all similar cross-sectional structure.

Figure 2:
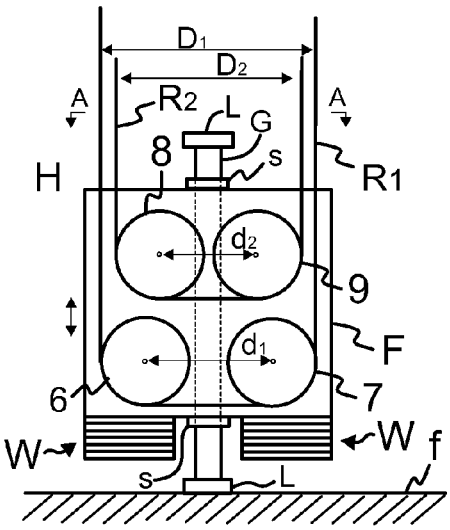
FIG. 2 illustrates preferred details for the elevator of FIG. 1.

FIG. 2 illustrates the elevator with further preferable details. The sections of the first set of ropes R1 arriving vertically down from the car 1 to said first lower rope wheels 6, 7 are at a first lateral rope-to-rope distance D1 from the sections of the first set of ropes R1 departing vertically upwards (preferably straight upwards) from said first lower rope wheels 6, 7 to the counterweight 2, and the sections of second set of ropes R2 arriving vertically down (preferably straight down) from the car 1 to said lower second rope wheels 8, 9 are at a second lateral rope-to-rope distance D2 from the sections of the second set of ropes R2 departing vertically upwards from said second lower rope wheels 8, 9 to the counterweight 2, which second lateral rope-to-rope distance D2 is smaller than said first lateral rope-to-rope distance D1.

Said first lower rope wheels 6, 7 and said second lower rope wheels 8, 9 are all mounted vertically movably. Thus, they can move downwards to tighten the second ropes. The lower rope wheels 6, 7, 8, 9 have a limited range of movement, preferably less than 2 meters, more preferably less than 1 meter as limited by a limiting mechanism L.

It is preferable, although not necessary, that all said lower rope wheels 6, 7, 8, 9 are mounted on a common frame F. In the preferred embodiment, said common frame F is vertically movable, whereby said movability is provided simply for all the lower rope wheels 6, 7, 8, 9 while maintaining their relative position. Also, in this way, they are connected to each other and movable vertically as one unit, whereby rope tightening can be simply provided and controlled. The frame F is movable vertically a limited range of movement, preferably less than 2 meters, more preferably less than 1 meter as mentioned above. The elevator comprises a limiting mechanism L for limiting the range of movement of the frame F and thereby the range of movement of the lower rope wheels 6, 7, 8, 9, in particular to be less than 2 meters, more preferably less than 1 meter. The movement of the frame F is guided by a guiding mechanism G, s. The guiding mechanism G, s comprises a guide rail G mounted fixedly on a stationary structure f as well as one or more counterpart(s) s therefor (in this case two counterparts) mounted on the frame F. The counterparts are preferably in the form of at least one slider or a roller element movable along the guide rail G.

For providing a tightening force exerted on the ropes R, which force is adequate to provide a substantial tightening effect advantageous for rope control of most elevators, the elevator comprises one or more weights W arranged to urge (either push or pull; in this case 'pull') the rope wheels 6, 7, 8, 9 downwards by force of gravity affecting on the weights W. The overall weight of said tension weight(s) W is preferably more than 100 kg, whereby considerable tension is achieved. The elevator is preferably at least a high-rise elevator, but preferably it is a high-rise elevator as in this context the challenges of the prior art have been found to be most serious. Preferably, the overall weight of said tension weight(s) W is from 300 kg to 3000 kg, more preferably from 500 to 3000 kg, most preferably from 1000 kg to 2000 kg, and the lifting height of the elevator is 100 meters of higher. These specific ranges of tension are specifically suitable for elevators having a lifting height of 100 meters or higher.

Said one or more first lower rope wheels 6, 7 includes two first lower rope wheels 6, 7 having parallel axes of rotation, which two first lower rope wheels wheels 6, 7 are horizontally spaced apart. Thus, the ropes are diverted with a configuration that is adaptable to fit in any elevator without differentiating wheel radius and/or bending radius of the ropes. The horizontal distance between the first lower rope wheels 6, 7 is preferably adjustable. For this purpose, the frame F preferably has several mounting positions for one or both of each of said first lower rope wheels 6, 7 and/or said second lower rope wheels 8, 9. This feature can be implemented in various ways obvious to a person skilled in the art based on disclosure of this application. The two first lower rope wheels wheels 6, 7 are spaced apart particularly in radial direction and they have the same vertical plane of rotation whereby the ropes can pass between them with ease. As illustrated, it is preferable that the two first lower rope wheels 6, 7 are on the same vertical level radially adjacent each other. The ropes are guided such that the first set of ropes R1 arriving vertically down to the rim of one 6 of said two first lower rope wheels 6, 7, turns around it, departs the rim thereof horizontally, passes to the rim of the other one 7 of said two first lower rope wheels 6, 7, turns around it, and departs vertically upwards from the rim thereof.

Correspondingly, said one or more second lower rope wheels 8, 9 includes two second lower rope wheels 8, 9 having parallel axes of rotation, which two first lower rope wheels 8, 9 are horizontally spaced apart. Thus, the ropes are diverted with a configuration that is adaptable to fit in any elevator without differentiating wheel radius and/or bending radius of the ropes. The horizontal distance between the second lower rope wheels 8, 9 is preferably adjustable. The two second lower rope wheels 8, 9 are spaced apart particularly in radial direction and they have the same vertical plane of rotation whereby the ropes can pass between them with ease. As illustrated, it is preferable that the two second lower rope wheels 8, 9 are on the same vertical level radially adjacent each other. The ropes are guided such that the second set of ropes R2 arriving vertically down to the rim of one 8 of said two second lower rope wheels 8, 9, turns around it, departs the rim thereof horizontally, passes to the rim of the other one 9 of said two second lower rope wheels 8, 9, turns around it, and departs vertically upwards from the rim thereof.

Said one or more second lower rope wheels 8, 9 being above the one or more first rope wheels 6, 7, the vertical projections of the first lower rope wheels 6, 7 and the vertical projections of the second lower rope wheels 8, 9 at least substantially overlap. In the preferred embodiment presented in FIG. 3, they overlap substantially, but only partially because thereby ropes of the first set R1 and the second set R2 can be effectively guided to pass relative to each other with adequate running clearance.

For enabling easy passage of the ropes said two first lower rope wheels 6, 7 are radially adjacent each other at a first lateral distance d1 and said two second lower rope wheels 8, 9 are radially adjacent each other at a second lateral distance d2, which is smaller than said first distance d1. Thus, the second set of ropes R2 as well as the two second lower rope wheels 8, 9 fit above the first lower rope wheels 6, 7 inside the first loop of ropes.

Figure 3:
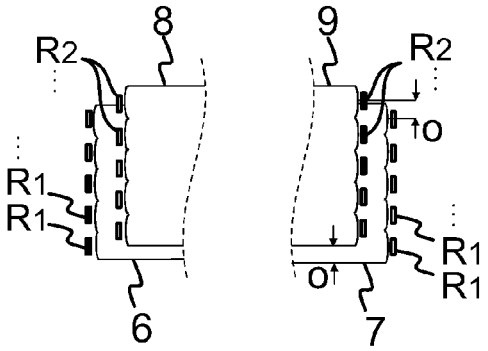
FIG. 3 illustrates further preferred details for the elevator of FIG. 1.

As illustrated in FIG. 3, it is preferable that the ropes of the first set of ropes R1 and the ropes of the second set of ropes R2 are interlaced as viewed in axial direction of the rope wheels 6, 7, 8, 9, i.e. ropes of the first set of ropes R1 are positioned at the point of spaces between immediately adjacent ropes of the second set of ropes R2, and ropes of the second set of ropes R2 are positioned at the point of spaces between immediately adjacent ropes of the first set of ropes R1, as viewed in axial direction of the rope wheels 6, 7, 8, 9. The ropes are then particularly preferably centrally positioned at the point of said spaces. The interlaced configuration is achieved in the embodiment illustrated in FIG. 3 such that the circumferential rope contact areas of the first lower rope wheels and the second lower rope wheels are offset in axial direction of the wheels. Particularly, the first lower rope wheels 6, 7 and the second lower rope wheels 8, 9 are axially offset such that the ropes of the first set of ropes R1 and the ropes of the second set of ropes R2 are interlaced as viewed in axial direction of the rope wheels 6, 7, 8, 9. The interlaced configuration reduces the likelihood of disturbation between the sets or ropes R1, R2, e.g. reducing likelihood of contact and air movement which might increase fluttering of ropes. As a consequence, the running clearances can be set small. For ensuring considerably reduced likelihood of rope contact between ropes of first and second sets R1, R2, it is preferable that the space between immediately adjacent ropes is greater (as measured in width direction of the rope) than the width of an individual rope. Even though preferable positioning the rope sets R1 and R2 in interlaced configuration is not necessary, so it is not necessary that all the lower rope wheels 6, 7, 8, 9 are axially offset. In that case, all the lower rope wheels 6, 7, 8, 9 have the same vertical plane of rotation.

As for the particular position of the rope wheels, it is preferable that said lower rope wheels 6, 7, 8, 9 are mounted inside the lower end of the hoistway H, as illustrated. Said upper rope wheels 3, 4 on the other hand are preferably mounted either inside the upper end of the hoistway, as illustrated or alternatively inside a separate space, which is beside or above the upper end of the hoistway H.

So as to ensure maximal space savings, it is preferable that all said first and second rope wheels 6, 7, 8, 9 have a parallel axes of rotation, as in the embodiments illustrated. This is however not necessary, because considerable advantages can be achieved also if the first lower rope wheels 6, 7 have with each other parallel axes of rotation, and the second lower rope wheels 7, 8 have parallel axes of rotation with each other but at a slight angle relative to the axes of the first lower rope wheels 6, 7. Advantages can be achieved if said angle is less than 10 degrees, the advantages being the greater the smaller is the angle. Thus, the angle is preferably less than 5 degrees, but most preferably zero.

Figure 4:
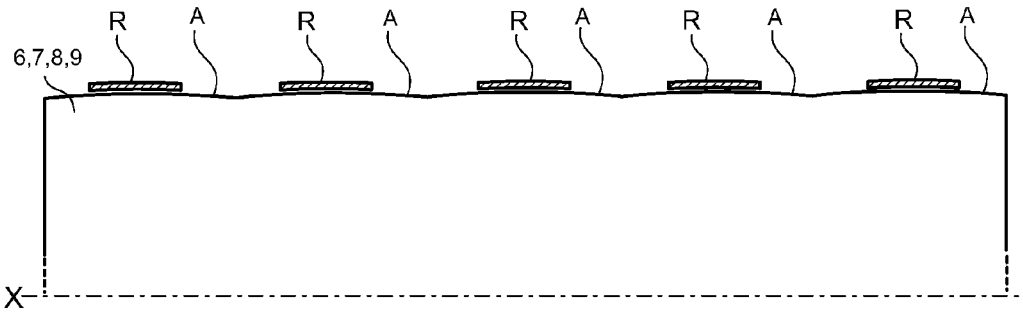
FIG. 4 illustrates further preferred details for the elevator of FIG. 1.

Each lower rope wheel 6, 7, 8, 9 comprises a plurality of circumferential rope contact areas A distributed in axial direction X thereof, and one of said ropes R passes against each of said circumferential rope contact areas A. FIG. 4 illustrates schematically a cross sectional view of the ropes as they are preferably positioned against the lower rope wheels 6, 7, 8, 9. As illustrated, the rope wheels 6, 7, 8, 9 are in the illustrated embodiments cambered, particularly each of said rope contact areas A is cambered. Thus, each rope wheel 6, 7, 8, 9 comprises a cambered circumferential rope contact area A for each of said one or more ropes arranged to pass around the rope wheel in question, against which circumferential rope contact area A one rope is arranged to pass. In this way, the axial position, i.e. the position of each of said belt-shaped ropes R in the axial direction X of the wheel 6, 7, 8, 9 around which it passes, is controlled. In this preferred embodiment, each cambered circumferential rope contact area A has a convex shape against the peak of which the rope R passes. The cambered shape tends to keep the rope passing around it positioned resting against the peak thereof, thereby resisting displacement of the rope R away from this position in said axial direction X. Ropes tend to slightly wander against the cambered shape. For reducing the likelihood of rope contact between immediately adjacent individual ropes or ropes resting against the cambered wheel 6, 7, 8 or 9, it is preferable that the space between immediately adjacent ropes is enough to allow contact-free wandering, for which purpose said space is preferably greater (in width direction) than the width of an individual rope R; R1; R2.

In the context where the lateral guidance of the lower ropes R is provided with rope wheels 6, 7, 8, 9, which are cambered, it is particularly advantageous that the ropes of the first set of ropes R1 and the ropes of the second set of ropes R2 are interlaced as viewed in axial direction of the rope wheels 6, 7, 8, 9. This is because having relatively wide spaces between individual ropes is simultaneously beneficial for safe implementation of both the cambered guidance and the interlaced configuration between the rope sets R1, R2.

In the embodiments illustrated, the ropes have been guided by a cambered shape of the rope wheel around which they pass. One of ordinary skill in the art will understand based on the disclosure of this application that alternatively any of a variety of alternative ways to guide the ropes could be used, such as polyvee-guidance for example.

In the embodiments illustrated, there are exactly two of said one or more first rope wheels 6, 7 as well as exactly two of said one or more second rope wheels 8, 9. However, there may be different number of said wheels 6, 7 and or 8, 9. For example, the elevator can be provided with only one of each or alternatively with exactly two of said one or more first rope wheels 6, 7 and only one of said one or more second rope wheels 8, 9. The latter alternative would be advantageous in the sense that the first set of ropes R1 can be effectively guided to pass the second lower rope wheel as well as the second set of ropes R2 with great clearance.

Each of said lower rope wheels 6, 7, 8, 9 may be manufactured to be of any known type, for instance to be in the form of a one-piece wheel or a wheelpack-type of wheel. Accordingly, it is preferable that each of said lower rope wheels 6, 7, 8, 9 is formed to be in the form of a one-piece wheel element having plural circumferential rope contact areas A, in particular one circumferential rope contact area A for each of the ropes of the rope set R1 or R2 that passes around the rope wheel in question, or alternatively, each of said lower rope wheels 6, 7, 8, 9 can be formed to be in the form of a wheelpack formed of plural wheel elements coaxially connected to each other, in particular one element being provided for each of the ropes of the rope set R1 or R2 that passes around the rope wheel in question, each element having only one of said circumferential rope contact areas A.

As mentioned, in the preferred embodiment one end of each rope R is fixed to the car 1 and the other end to the counterweight 2. In this case, it is preferable that all the lower ropes R extend vertically straight between the fixing point at the car and the lower rope wheel(s) around which they pass as well as vertically straight between the fixing point at the counterweight and the lower rope wheel(s) around which they pass. It is however possible to utilize the invention based on the disclosure of this application in elevator configuration wherein lower ropes are connected to the car and/or counterweight with ratio other than 1:1, such as 2:1.

In general, the second ropes R include at least two ropes, because each set of ropes R1, R2 must have at least one rope. However, in the preferred embodiments, said number of second ropes R is preferably great, in particular at least six as in this type of cases the space consumption issues become relevant. More preferably, the number is more than ten, such as 10-20, as in this type of cases the space consumption issues become most critical. It is preferable that in both sets R1, R2 the number of ropes is more than one. Particularly, the number of ropes in the first set of ropes R2 is preferably more than three, preferably 5-10. Correspondingly, the number of ropes in the second set of ropes R2 is more than three, preferably 5-10. Preferably, the number of ropes in the first set of ropes R2 is the same as the number of ropes in the second set of ropes R2.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims and their equivalents.

The invention claimed is:

1. An elevator, comprising:

a hoistway;

an elevator car vertically movable in the hoistway;

a counterweight vertically movable in the hoistway;

a number of upper rope wheels mounted higher than the car and counterweight;

a number of first ropes interconnecting the elevator car and counterweight, each of said first ropes passing around said upper rope wheels;

a number of lower rope wheels mounted lower than the car and counterweight; and a number of second ropes interconnecting the elevator car and counterweight, each of said second ropes passing around one or more of the lower rope wheels, wherein said lower rope wheels comprise:

one or more first lower rope wheels; and one or more second lower rope wheels above the one or more first rope wheels, and wherein said second ropes comprise:

a first set of ropes forming a first U-shaped loop of ropes hanging from the car and counterweight, and passing around said one or more first lower rope wheels; and a second set of ropes forming a second U-shaped loop of ropes hanging from the car and counterweight, inside the first loop of ropes, and passing around said one or more second lower rope wheels, wherein said one or more first lower rope wheels includes two horizontally spaced apart first wheels having parallel axes of rotation, said one or more second lower rope wheels includes two horizontally spaced apart second lower rope wheels having parallel axes of rotation, and wherein the one or more first lower rope wheels and the one or more second lower rope wheels are axially offset such that ropes of the first set of ropes and the ropes of the second set of ropes are interlaced as viewed in an axial direction of the rope wheels.

2. The elevator according claim 1, wherein sections of the first set of ropes arriving vertically down from the car to said one or more first lower rope wheels are at a first lateral rope-to-rope distance from sections of the first set of ropes departing vertically upwards from said one or more first lower rope wheels to the counterweight, and sections of second set of ropes arriving vertically down from the car to said one or more lower second rope wheels are at a second lateral rope-to-rope distance from sections of the second set of ropes departing vertically upwards from said one or more second lower rope wheels to the counterweight, the second lateral rope-to-rope distance is smaller than said first lateral rope-to-rope distance.

3. The elevator according to claim 2, wherein said one or more first lower rope wheels and said one or more second lower rope wheels all have the same diameter.

4. The elevator according to claim 2, wherein said one or more first lower rope wheels and said one or more second lower rope wheels are all mounted vertically movably.

5. The elevator according to claim 2, wherein said one or more first lower rope wheels and said one or more second lower rope wheels are all mounted on a common frame that is vertically movable.

6. The elevator according to claim 1, wherein said one or more first lower rope wheels and said one or more second lower rope wheels all have the same diameter.

7. The elevator according to claim 6, wherein said one or more first lower rope wheels and said one or more second lower rope wheels are all mounted vertically movably.

8. The elevator according to claim 1, wherein said one or more first lower rope wheels and said one or more second lower rope wheels are all mounted vertically movably.

9. The elevator according to claim 1, wherein said one or more first lower rope wheels and said one or more second lower rope wheels are all mounted on a common frame that is vertically movable.

10. The elevator according to claim 1, wherein the elevator comprises an urging mechanism arranged to urge the lower rope wheels downwards so as to tighten the second ropes.

11. The elevator according to claim 10, wherein said urging mechanism comprises one or more weights arranged to urge said one or more first lower rope wheels and said one or more second lower rope wheels downwards by force of gravity affecting on the weights.

12. The elevator according to claim 10, wherein said urging mechanism comprises one or more weights arranged to urge said one or more first lower rope wheels and said one or more second lower rope wheels downwards by force of gravity affecting on the weights, the overall weight of said one or more tension weights being more than 100 kg.

13. The elevator according to claim 1, wherein said second ropes are belt-shaped.

14. The elevator according to claim 1, wherein said two horizontally spaced apart first wheels are radially adjacent each other at a first lateral distance and said two horizontally spaced apart second lower rope wheels are radially adjacent each other at a second lateral distance that is smaller than said first distance.

15. The elevator according to claim 1, wherein vertical projections of the one or more first lower rope wheels and vertical projections of the one or more second lower rope wheels substantially overlap as viewed in the axial direction of the rope wheels.

16. The elevator according to claim 1, wherein each lower rope wheel comprises a plurality of circumferential rope contact areas distributed in an axial direction thereof, one of said second ropes passing against each circumferential rope contact area, and each of the rope contact areas is cambered.

* * * * *